US007640704B2

(12) United States Patent
Salerno

(10) Patent No.: US 7,640,704 B2
(45) Date of Patent: Jan. 5, 2010

(54) STRENGTHENED DOOR WITH STIFFENERS

(75) Inventor: Don S. Salerno, Hollywood, FL (US)

(73) Assignee: Speyer Door and Window, Inc., Boca Raton, FL (US)

( * ) Notice: Subject to any disclaimer, the term of this patent is extended or adjusted under 35 U.S.C. 154(b) by 40 days.

(21) Appl. No.: 12/021,134

(22) Filed: Jan. 28, 2008

(65) Prior Publication Data

US 2009/0165423 A1 Jul. 2, 2009

Related U.S. Application Data

(60) Provisional application No. 61/018,159, filed on Dec. 31, 2007.

(51) Int. Cl.
*E04C 1/00* (2006.01)
*E06B 3/70* (2006.01)

(52) U.S. Cl. ..... 52/309.9; 52/309.11; 52/455

(58) Field of Classification Search ..... 52/455, 52/456, 783.1, 783.12, 783.14, 783.15, 782.1, 52/784.1

See application file for complete search history.

(56) References Cited

U.S. PATENT DOCUMENTS 4,765,105 A * 8/1988 Tissington et al. ..... 52/309.11
5,020,292 A * 6/1991 Strom et al. ..... 52/309.9
5,293,726 A * 3/1994 Schick ..... 52/455
5,522,195 A * 6/1996 Bargen ..... 52/455
6,112,496 A * 9/2000 Hugus et al. ..... 52/784.11
6,619,005 B1 * 9/2003 Chen ..... 52/455
6,772,818 B2 * 8/2004 Whitley et al. ..... 160/236
7,185,468 B2 * 3/2007 Clark et al. ..... 52/455
2005/0102908 A1 * 5/2005 Martin ..... 49/455
2006/0207199 A1 * 9/2006 Darnell ..... 52/232

* cited by examiner

*Primary Examiner*—Richard E Chilcot, Jr.
*Assistant Examiner*—Benjamin Pevarski
(74) *Attorney, Agent, or Firm*—Scott D. Paul, Esq.; Steven M. Greenberg, Esq.; Carey, Rodriguez, Greenberg & Paul LLP

(57) ABSTRACT

A door comprises a frame, first and second outer skins, and first and second stiffeners. The first and second outer skins are respectively connected to first and second sides of the frame, and the first and second stiffeners are positioned between the first and second outer skins and are attached to the frame. The first stiffener is connected to the first side of the frame, and the second stiffener is connected to the second side of the frame. The first and second outer skins are respectively connected to the first and second stiffeners at positions adjacent the frame. The first and second stiffeners are joined together within an area defined by the frame, and the first and second stiffeners are joined together along a plane approximately equidistant from the first and second outer skins. The door also includes a window.

13 Claims, 7 Drawing Sheets

STRENGTHENED DOOR WITH STIFFENERS

CROSS-REFERENCE TO RELATED APPLICATIONS

This application claims the benefit of U.S. Patent Application No. 61/018,159, filed on Dec. 31, 2007, which is incorporated herein in its entirety.

BACKGROUND OF THE INVENTION

1. Field of the Invention

The disclosure relates generally to doors, such as an entry door and, more specifically, to a door system strengthened by stiffeners.

2. Description of the Related Art

A common type of door includes a frame to form the periphery of the door, a flat sheet on both the front and back of the door. A gap may exist between the flat sheets, and the gap may remain empty or be filled with an insulator. This type of door, although easy to manufacture, can be both decoratively uninteresting and structurally deficient.

Depending upon the area of the country (e.g., hurricane-prone areas) and the type of door (e.g., an entry door), the door may be required to meet certain standards. For example, hurricane testing involves firing one or more projectiles (e.g., a 2"×4" piece of wood) at the door and subsequently subjecting the door to simulated wind load cycling. The door is then tested for structural integrity and the ability to continue to keep out rain/wind. A similar type of testing is also performed on a window within the door. Many types of doors (with or without windows) fail to pass this type of testing. There is, therefore, a need for improved door system that provides for greater structural integrity either for the door itself or for a window within the door while at the same time providing a door designer with a greater flexibility for the types of designs/materials used to manufacture the door.

BRIEF SUMMARY OF THE INVENTION

Embodiments of the invention address deficiencies of the art with respect to providing an improved door having a greater structural integrity. In this regard, a door comprises a frame, first and second outer skins, and first and second stiffeners. The first and second outer skins are respectively connected to first and second sides of the frame, and the first and second stiffeners are positioned between the first and second outer skins and are attached to the frame. The first stiffener is connected to the first side of the frame, and the second stiffener is connected to the second side of the frame. The first and second outer skins are respectively connected to the first and second stiffeners at positions adjacent the frame. The first and second stiffeners are joined together within an area defined by the frame, and the first and second stiffeners are joined together along a plane approximately equidistant from the first and second outer skins. The door also includes a window.

In another aspect of the door system, a gap exists between the first stiffener and the first outer skin and between the second stiffener and the second outer skin where the first stiffener is joined together with the second stiffener. The first outer skin and the first stiffener define a first cavity therebetween, and the second outer skin and the second stiffener define a second cavity therebetween. An insulator is positioned within the first cavity and the second cavity, and the insulator is a rigid foam. The insulator is substantially completely between the first and second outer skins.

In further aspects of the door system, the frame defines a complete outer periphery of the door, and frame includes an outer shell. An insulator is positioned substantially completely within the outer shell. The first and second skins are formed from a different material than the first and second stiffeners. Each of the first and second stiffeners include first and second portions. The first and second portions are respectively within first and second separate planes, and the first and second planes are substantially parallel to and offset from one another. The first and second stiffeners extend substantially along an entire height and width of the door.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
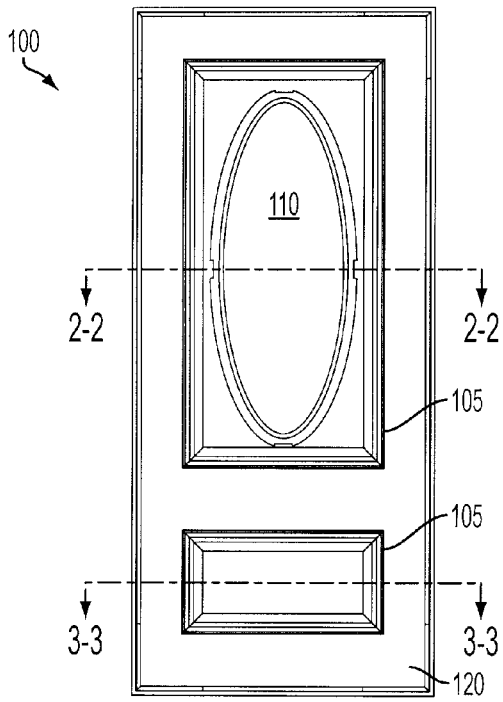
FIG. 1 is a front view of a door system in accordance with the inventive arrangements.
Figure 2:
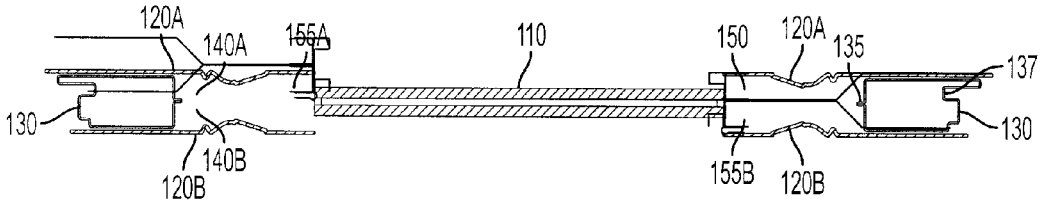
FIG. 2 is cross-section of the door system in FIG. 1 taken along line 2-2.
Figure 3:
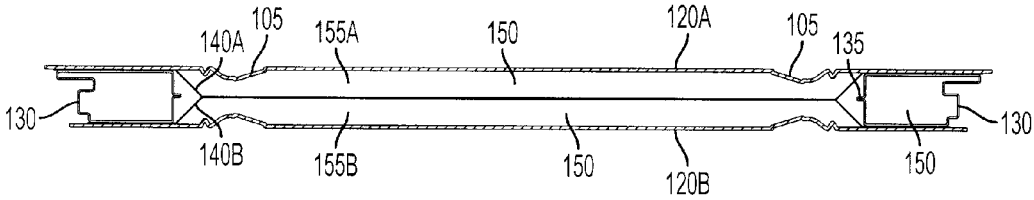
FIG. 3 is a cross-section of the door system in FIG. 1 taken along line 3-3.
Figure 4:
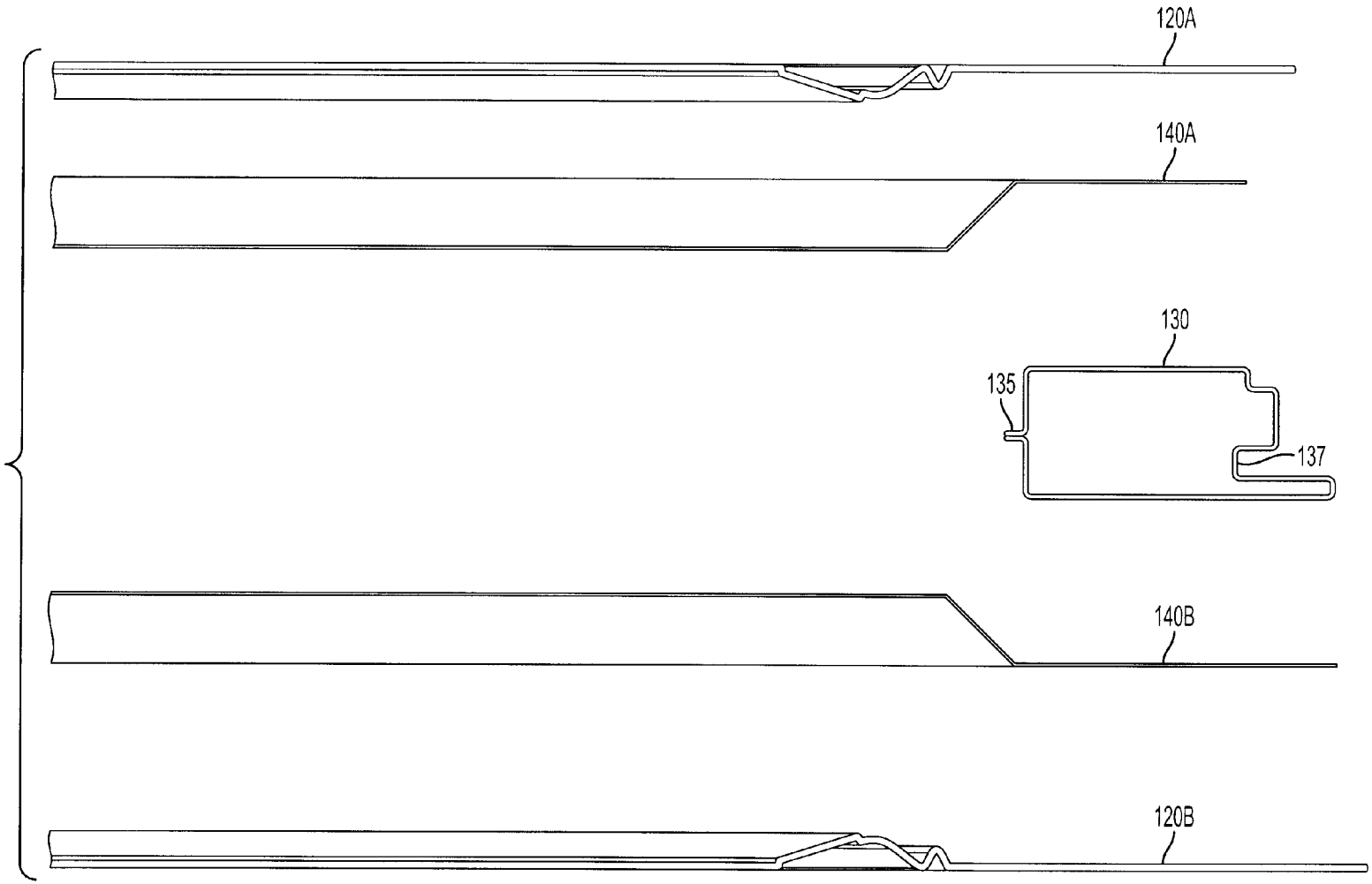
FIG. 4 is an exploded, cross-sectional, partial view of the door system in accordance with the inventive arrangements.
Figure 6:
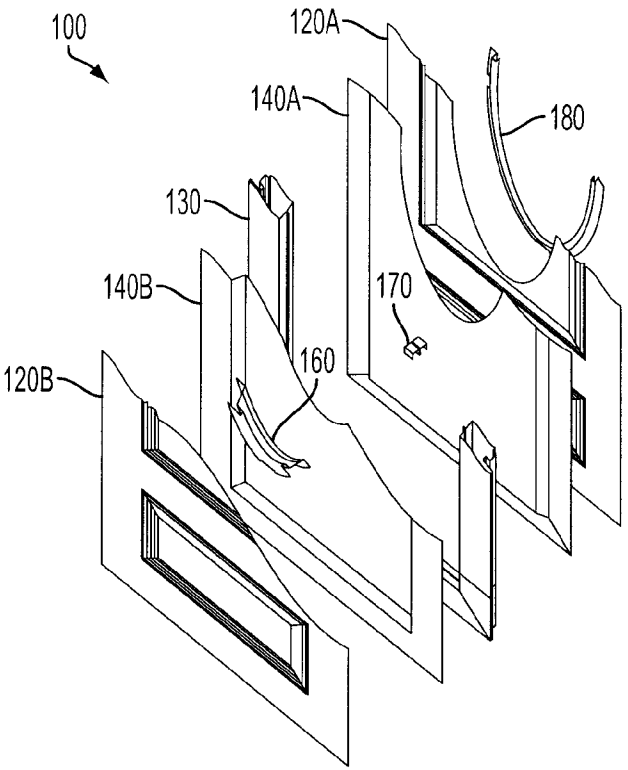
FIG. 6 is an exploded, perspective, partial view of the door system in accordance with the inventive arrangements.
Figure 5:
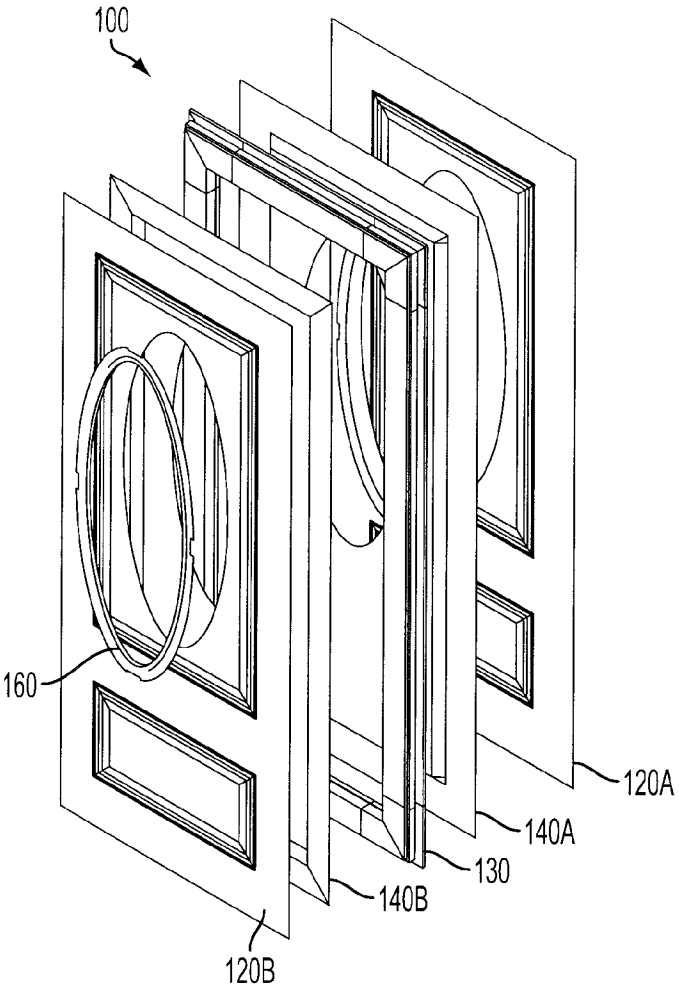
FIG. 5 is an exploded, perspective view of the door system in accordance with the inventive arrangements.

FIGS. 1-6 illustrate an exemplar door system 100 in accordance with the inventive arrangements. The door 100 includes a frame 130, first and second outer skins 120A, 120B, and first and second stiffeners 140A, 140B. The first and second outer skins 120A, 120B are respectively connected to first and second sides of the frame 130, and the first and second stiffeners 120A, 120B are positioned between the first and second outer skins 120A, 120B. In certain aspects of the door system 100, the first and second stiffeners 120A, 120B provide additional structural support and impact/penetration resistance to the door system 100.

Although shown as an entry door, the door system 100 is not limited in this manner. For example, the door system 100 may be also used with pocket doors, sliding doors, French doors, and garage doors. Additionally, the door system 100 may include one or more windows 110 and/or decorative features 105, such as molding and millwork.

The outer skins 120A, 120B are not limited as to a particular material. Example materials for use as the outer skins 120A, 120B include steel, aluminum, wood, plastic, and composites. In certain aspects of the door system 100, decorative features 105 of the door system may be formed within the outer skins 120A, 120B.

The stiffeners 140A, 140B are also not limited as to a particular material. Example materials for use as the stiffeners 140A, 140B include steel, aluminum, wood, plastic, and composites. However, in certain aspects of the door system 100, the stiffeners 140A, 140B are formed from a structural material, such as steel or aluminum so as to provide the additional structural support and impact/penetration resistance to the door system 100. By using a structural material for the stiffeners 140A, 140B, in certain aspects of the door system 100, the first and second outer skins 120A, 120B may be formed from a different material, yet less structurally-sound material. This different material, however, may have other desirable characteristics, such as improved environmental resistance, workability, and/or decorativeness.

The frame 130 is also not limited as to a particular material. Moreover, the frame 130 may be formed from different materials. For example, a lower portion of the frame 130 may be formed from a more water- and/or decay-resistant material than other portions of the frame 130. Example materials for use as the frame 130 include steel, aluminum, wood, plastic, and composites.

The frame 130 may include an outer shell or the frame 130 can be formed from a solid material. If the frame 130 is formed using an outer shell, the outer shell of the frame 130 may be empty or substantially completely filled with an insulator 150, such as a rigid foam. In certain aspects, certain linear portions of the outer shell of the frame 130 are formed from a single piece of material and joined together along a seam 135.

Although not limited in this manner, the frame 130 may define a complete outer periphery (see FIG. 5) of the door system 100. Additionally, the frame 130 may include an outer profile 137 that is adapted to engage with a header, jambs, and a sill (not shown) that surround the door system 100.

In certain aspects of the door system 100, the first stiffener 140A is connected to the first side of the frame 130, and the second stiffener 140B is connected to the second side of the frame 130. The first and second outer skins 120A, 120B may be respectively connected to the first and second stiffeners 140A, 140B at positions adjacent the frame 130. The first and second stiffeners 140A, 140B may extend substantially along an entire height and width of the door system 100, and in so doing, the first and second stiffeners 140A, 140B are connected to the frame 130 along the complete periphery, as defined by the frame 130 of the door system 100. Also, with the exception of holes for such features as windows and door knobs, the first and second stiffeners 140A, 140B may extend throughout the entire interior, as defined by the frame 130, of the door system 100. In so doing, the first and second stiffeners 140A, 140B may provide a more complete puncture resistance to the door system 100.

Each of the first and second stiffeners 140A, 140B may include first and second portions. The first portions of each of the first and second stiffeners 140A, 140B may directly connect to the first and second sides of the frame 130. Also, the second portions of each of the first and second stiffeners 140A, 140B may be joined together within an area defined by the frame 130. Although not limited in this manner, the first and second portions are respectively within first and second separate planes, and the first and second planes are substantially parallel to and offset from one another.

In certain aspects of the door system 100, the first and second stiffeners 140A, 140B are joined together along a plane approximately equidistant from the first and second outer skins 120A, 120B. Also, a gap exists between the first stiffener 140A and the first outer skin 120B and between the second stiffener 140B and the second outer skin 120B where the first stiffener 140A is joined together with the second stiffener 140B. Thus, the first outer skin 120A and the first stiffener 140A define a first cavity 155A therebetween, and the second outer skin 120B and the second stiffener 140B define a second cavity 155B therebetween.

The door system 100 may also include an insulator 150 positioned between the first and second outer skins 120A, 120B, and in certain aspects, the insulator 150 may substantially completely fill the cavities 155A, 155B within the door system 100. Although many types of insulators 150 are known as being capable of used within a door system 100, in certain aspects of the door system 100, the insulator 150 is a rigid foam.

Figure 7A:
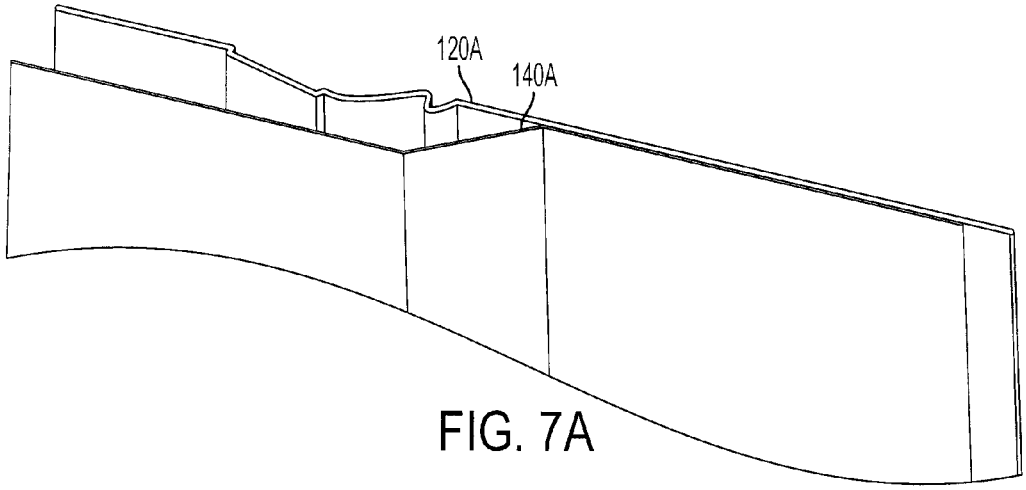
FIGS. 7A-7H are cross-sectional, perspective views showing assembly of the door and window system in accordance with the inventive arrangements.
Figure 7B:
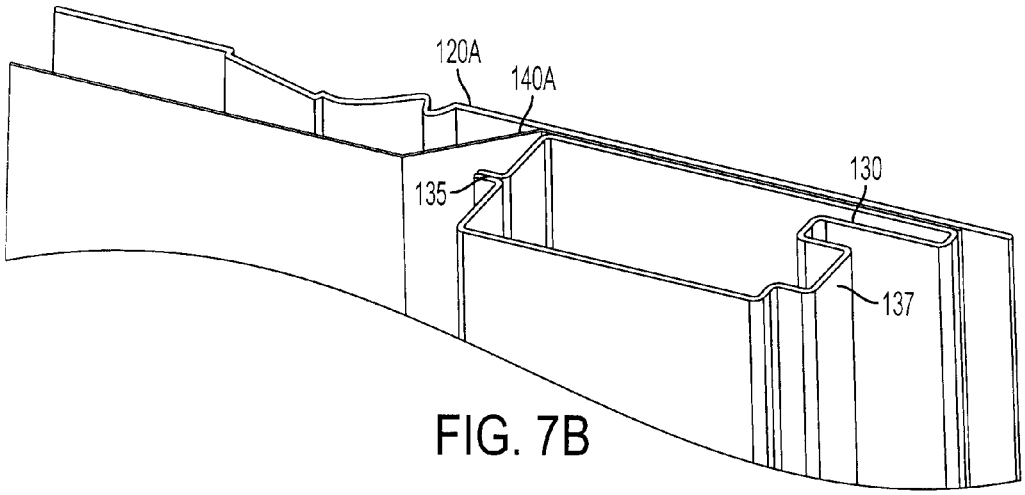
Figure 7C:
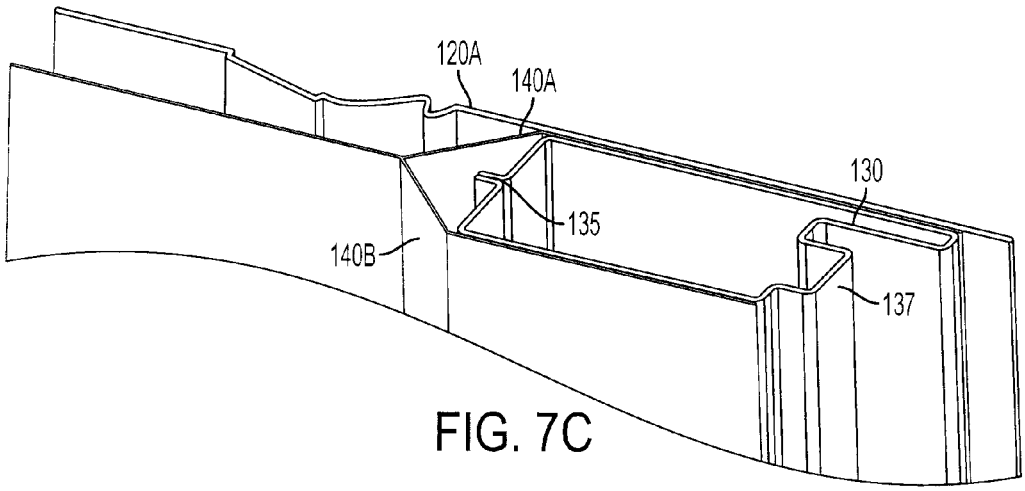
Figure 7D:
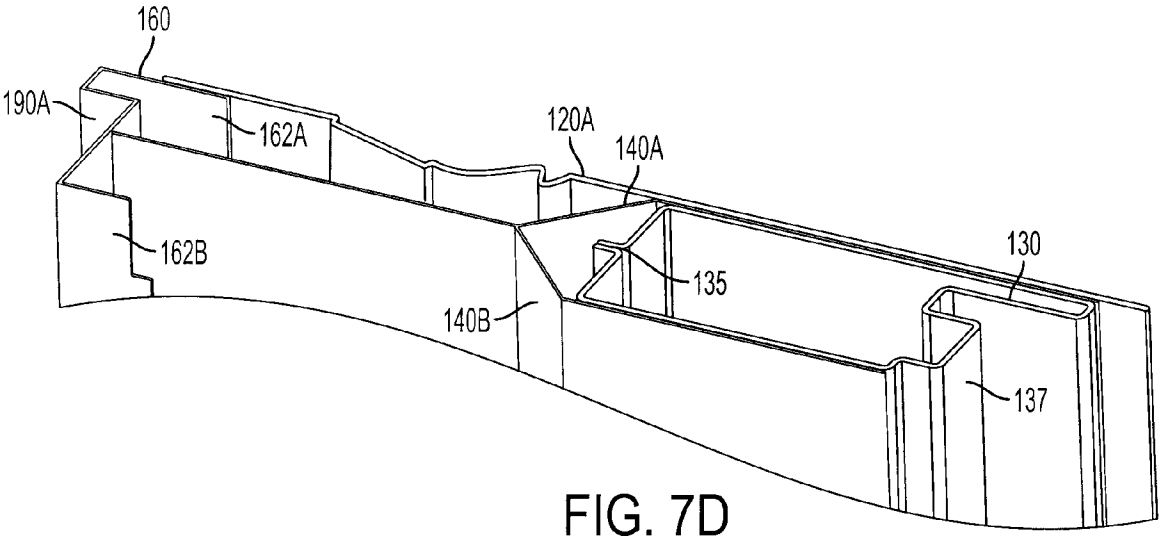
Figure 7E:
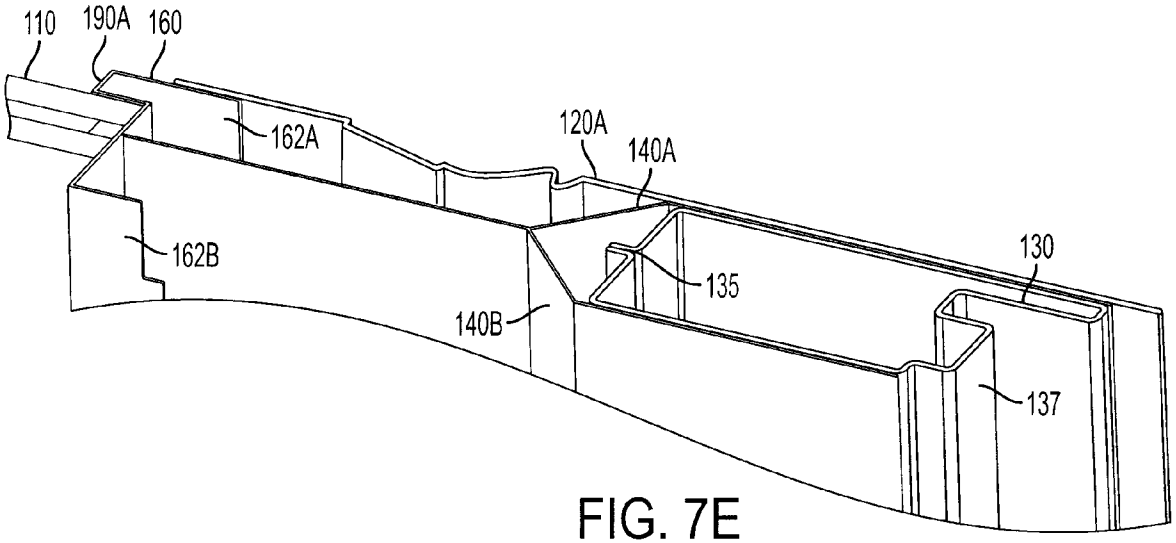
Figure 7F:
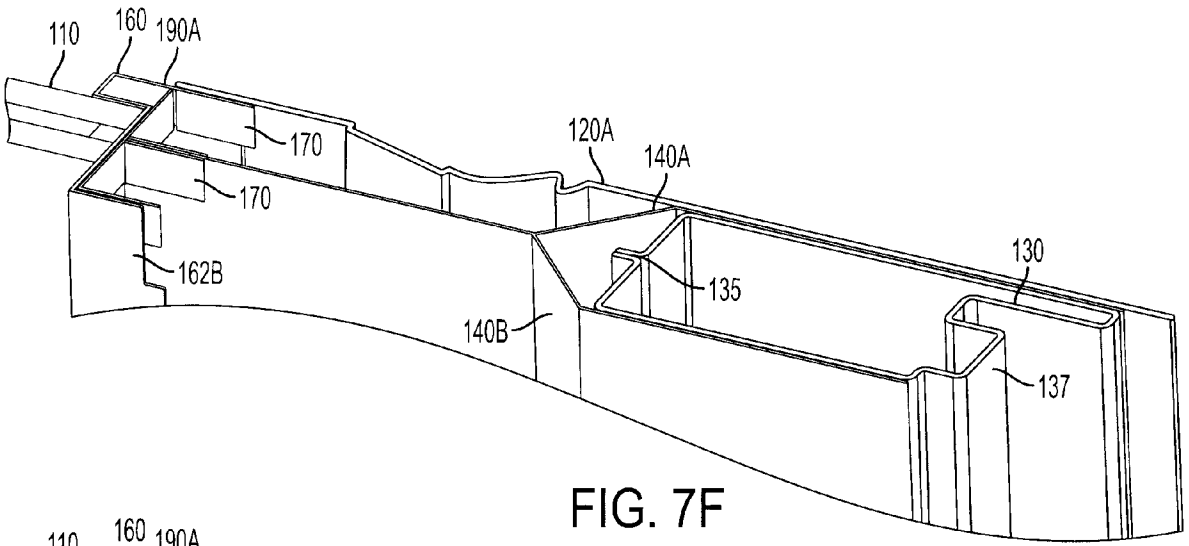
Figure 7G:
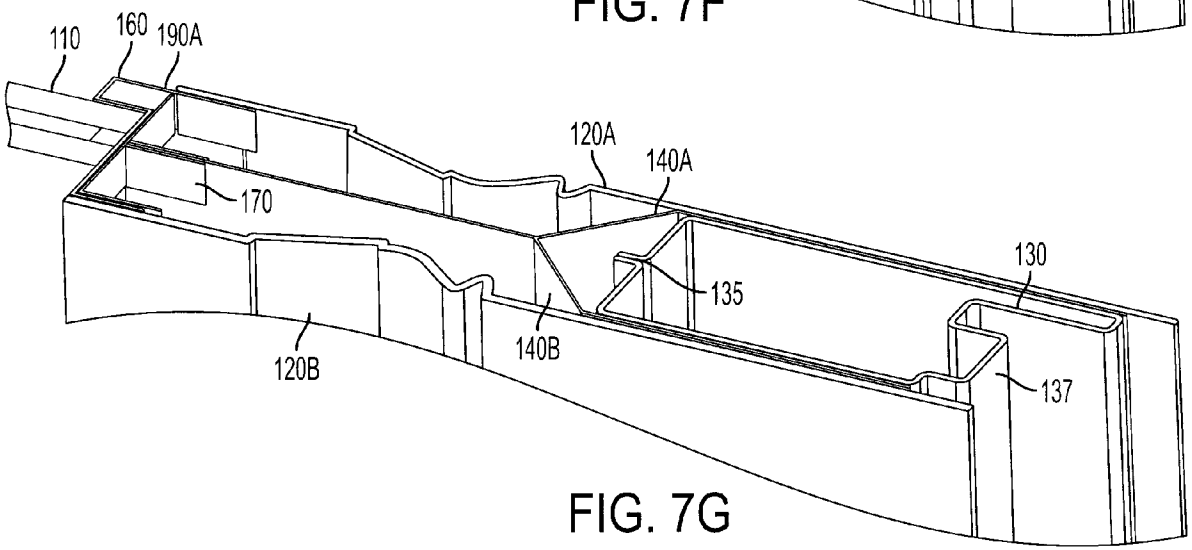
Figure 7H:
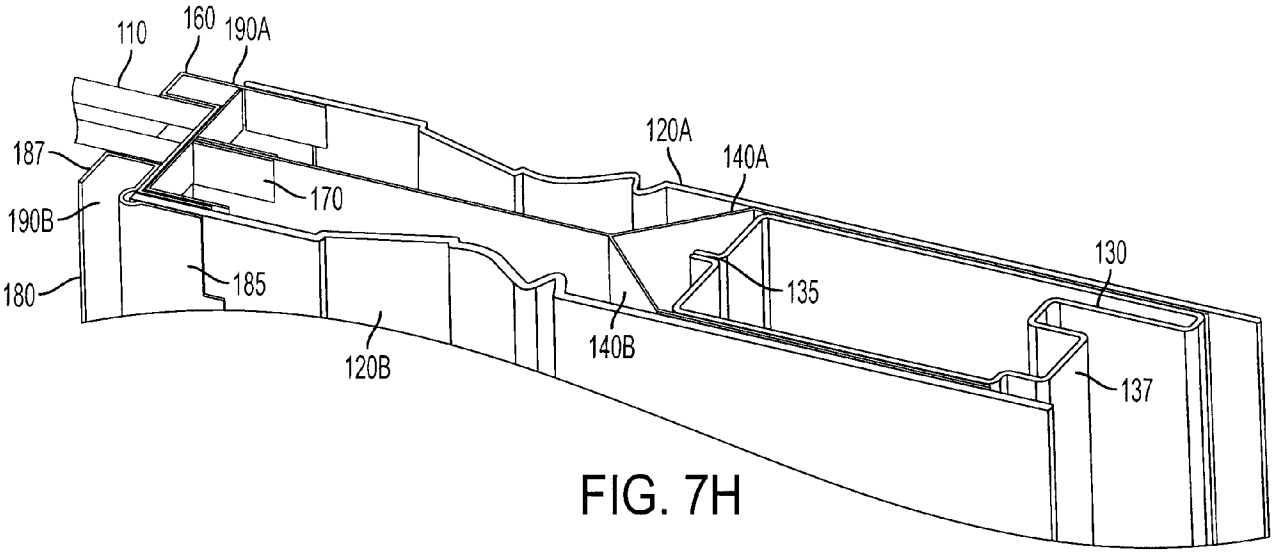
Figure 8:
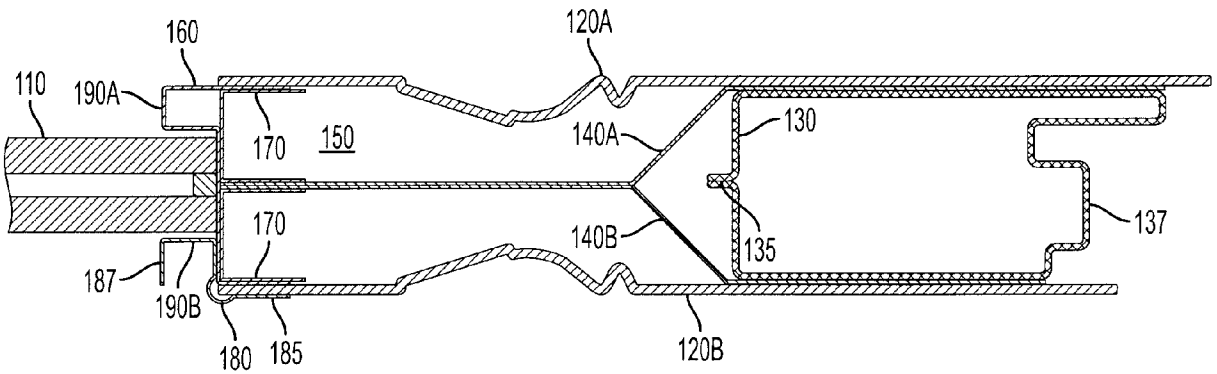
FIG. 8 is a cross-sectional view of the door and window system in FIGS. 7A-7H.

Referring to FIGS. 7A-7H and to FIG. 8, various steps for assembling the door system 100 and for securing a window 110 to the door system 100 is illustrated. The order and constitution of the steps illustrated is not necessarily indicative of the only method of assembling the door system 100. For example, the first and second outer skins 120A, 120B may be assembled after the first and second stiffeners 140A, 140B are attached to the frame 130.

In FIG. 7A, the first outer skin 120A is attached to the first stiffener 140A. Based upon configurations of the first outer skin 120A and the first stiffener 140A, in certain locations, a gap exists between the first outer skin 120A and the first stiffener 140A, and in certain locations the first outer skin 120A is connected to the first stiffener 140A. In FIG. 7B, the first stiffener 140A connects to the first side of the frame 130 at adjacent to where the first stiffener 140A is connected to the first outer skin 120A.

Referring to FIG. 7C, the second stiffener 140B is connected to both the first stiffener 140A and to the second side of the frame 130. The second stiffener 140B is connected to the first stiffener 140A in an area defined by the frame 130, and the second stiffener 140B is connected to the second side of the frame 130 at a location adjacent to where the second stiffener 140B will eventually be connected to the second outer skin 120B (see FIG. 7G).

In FIG. 7D, a bracket 160 is attached to the door system 100 around the location of a portal in which the window 110 will be positioned. The bracket 160 includes a first window support 190A and first and second legs 162A, 162B. The first and second legs 162A, 162B are respectively attached to the first and second outer skins 120A, 120B. The first window support 190A extends in an opposite direction from the legs 162A, 162B and provides a surface upon which a first face of the window 110 is to be supported. Referring to FIG. 7E, the window 110 is placed within the portal and the first face of the window 110 is placed adjacent the supporting surface of the first window support 190A.

In FIG. 7F, one or more spacers 170 may be used to maintain the gap between the first outer skin 120A and the first stiffener 140A and the gap between the second outer skin 120B and the second stiffener 140B. Alternatively, or in addition to, the spacers 170 may be used to connect the bracket 160 to one or more of the first and second outer skins 120A, 120B and/or the first and second stiffeners 140A, 140B. Although not limited in this manner, in certain aspects of the door system 100, the spacers have a U-shaped cross-section.

In FIG. 7G, the second skin 120B is attached, which can include connecting the second skin 120B to the second stiffener 140B and to the spacer 170.

Referring to FIG. 7H, a retainer 180 is attached to the door system 100 around the location of the portal in which the window 110 is positioned. The retainer 180 includes a second window support 190B and a leg 185, which is attached to the second outer skin 120B. The second window support 190B extends in an opposite direction from the leg 185 provides a surface upon which a second face of the window 110 is supported. The second face of the window 110 is positioned opposite of the first face of the window 110.

The retainer 180 may also include a flange 187 extending away from the window 110 and attached to a distal end of the second window support 190B. Through use of the bracket 160 and retainer 180, the window 110 may be positioned and held within the door system 100 in an improved structurally-secure manner.

What is claimed is:

1. A door, comprising:

a frame;

first and second outer skins respectively connected to first and second sides of the frame; and first and second stiffeners positioned between the first and second outer skins and attached to the frame, wherein the first and second stiffeners are joined together within an area defined by the frame, and the first and second stiffeners are joined together along a plane approximately equidistant from the first and second outer skins the first stiffener is connected to the first side of the frame, and the second stiffener is connected to the second side of the frame.

2. The door according to claim 1, wherein the first and second outer skins respectively connected to the first and second stiffeners at positions adjacent the frame.

3. The door according to claim 1, wherein a gap exists between the first stiffener and the first outer skin and between the second stiffener and the second outer skin where the first stiffener is joined together with the second stiffener.

4. The door according to claim 1, wherein the first outer skin and the first stiffener define a first cavity therebetween, and the second outer skin and the second stiffener define a second cavity therebetween.

5. The door according to claim 4, further comprising an insulator is positioned within the first cavity and the second cavity.

6. The door according to claim 5, wherein the insulator is a rigid foam.

7. The door according to claim 6, further comprising an insulator substantially completely between the first and second outer skins.

8. The door according to claim 7, wherein the insulator is a rigid foam.

9. The door according to claim 1, wherein the frame defines a complete outer periphery of the door.

10. The door according to claim 1, further comprising a window.

11. The door according to claim 1, wherein the first and second skins are formed from a different material than the first and second stiffeners.

12. The door according to claim 1, wherein each of the first and second stiffeners include first and second portions, the first and second portions are respectively within first and second separate planes, and the first and second planes are substantially parallel to and offset from one another.

13. The door according to claim 1, wherein the first and second stiffeners extend substantially along an entire height and width of the door.

* * * * *